US010224168B2

(12) United States Patent
Nan

(10) Patent No.: US 10,224,168 B2
(45) Date of Patent: Mar. 5, 2019

(54) FUSE PROTECTOR WITH A PLURALITY OF FUSES

(71) Applicant: BEIJING PEOPLE'S ELECTRIC PLANT CO., LTD., Beijing (CN)

(72) Inventor: Yin Nan, Beijing (CN)

(73) Assignee: BEIJING PEOPLE'S ELECTRIC PLANT CO., LTD, Beijing (CN)

( * ) Notice: Subject to any disclaimer, the term of this patent is extended or adjusted under 35 U.S.C. 154(b) by 0 days.

(21) Appl. No.: 15/310,971

(22) PCT Filed: Mar. 20, 2015

(86) PCT No.: PCT/CN2015/074655

§ 371 (c)(1),
(2) Date: Nov. 14, 2016

(87) PCT Pub. No.: WO2015/172604

PCT Pub. Date: Nov. 19, 2015

(65) Prior Publication Data

US 2017/0110280 A1 Apr. 20, 2017

(30) Foreign Application Priority Data

May 16, 2014 (CN) ..... 2014 1 0206784

(51) Int. Cl.
*H01H 85/54* (2006.01)
*H01H 85/08* (2006.01)
(Continued)

(52) U.S. Cl.
CPC ..... *H01H 85/54* (2013.01); *H01H 9/102* (2013.01); *H01H 85/08* (2013.01); *H01H 85/12* (2013.01);
(Continued)

(58) Field of Classification Search
CPC ..... H01H 85/54; H01H 85/32; H01H 85/08; H01H 85/12; H01H 85/175
(Continued)

(56) References Cited

U.S. PATENT DOCUMENTS 3,976,967 A * 8/1976 Magherini ..... H01R 13/68 337/211
4,121,186 A * 10/1978 Santilli ..... H01H 85/303 337/161
(Continued)

FOREIGN PATENT DOCUMENTS

CN 1335635 A 2/2002
CN 101393829 A 3/2009
(Continued)

OTHER PUBLICATIONS

Author Unknown, Chinese Office Action and Search Report dated Nov. 4, 2016, Chinese Application No. 2014102067843, filed May 16, 2014, pp. 1-6 (including English translation).
(Continued)

*Primary Examiner* — Jerry Wu
*Assistant Examiner* — Stephen S Sul
(74) *Attorney, Agent, or Firm* — MH2 Technology Law Group LLP

(57) ABSTRACT

A fuse protector with a plurality of fuses comprises a fuse protector base, a fuse carrier, and fuse elements. The fuse elements are disposed on the fuse carrier, and the fuse carrier is inserted in the fuse protector base. One side of the fuse protector base is provided with at least two wiring assemblies, and the other side of the fuse protector base is provided with at least two wiring assemblies. The fuse protector base is further provided with base contacts corresponding to the wiring assemblies. The fuse carrier is inserted into the fuse protector base. When the fuse carrier is pulled out of the fuse
(Continued)

protector base, at least four breaking points are formed at the same time, and the voltage of an arc is distributed to the four contact points. Therefore, the voltage of the arc is effectively reduced, space is saved.

14 Claims, 6 Drawing Sheets

(51) Int. Cl.

| | |
|---|---|
| ***H01H 85/12*** | (2006.01) |
| ***H01H 85/175*** | (2006.01) |
| ***H01H 85/32*** | (2006.01) |
| ***H01H 9/10*** | (2006.01) |
| *H01H 85/041* | (2006.01) |
| *H01H 85/30* | (2006.01) |

(52) U.S. Cl.
CPC ..... *H01H 85/175* (2013.01); *H01H 85/32* (2013.01); *H01H 85/547* (2013.01); *H01H 85/0418* (2013.01); *H01H 85/30* (2013.01)

(58) Field of Classification Search
USPC ..... 337/150, 168, 227, 411
See application file for complete search history.

(56) References Cited

U.S. PATENT DOCUMENTS

| | | | | |
|---|---|---|---|---|
| 4,488,767 | A | 12/1984 | Lehman et al. | |
| 4,820,195 | A | 4/1989 | Siemon | |
| 5,002,505 | A * | 3/1991 | Jones | H01H 85/32 337/213 |
| 2002/0064999 | A1 | 5/2002 | Kobayashi et al. | |
| 2010/0259355 | A1 * | 10/2010 | Buettner | H01H 85/25 337/187 |
| 2013/0023156 | A1 * | 1/2013 | von zur Muehlen | H01H 85/202 439/620.26 |
| 2013/0257580 | A1 * | 10/2013 | Gilman | H01H 85/157 337/248 |

FOREIGN PATENT DOCUMENTS

| | | | |
|---|---|---|---|
| CN | 102122594 | A | 7/2011 |
| CN | 204441232 | U | 7/2015 |
| GB | 1400553 | A | 7/1975 |
| JP | S44-026258 | B | 11/1969 |
| JP | S57126040 | A | 8/1982 |
| JP | S59-230273 | A | 12/1984 |
| JP | H01-088448 | U | 6/1989 |
| JP | H01-146221 | | 6/1989 |
| JP | 08236001 | A | 9/1996 |
| JP | 2006-179311 | A | 7/2006 |
| JP | 2010-287558 | A | 12/2010 |

OTHER PUBLICATIONS

Author Unknown, Chinese Office Action and Search Report dated Apr. 5, 2017, Chinese Application No. 2014102067843, filed May 16, 2014, pp. 1-6 (including English translation).
Japanese Office Action dated Oct. 3, 2017, JP Application No. 2016-557922, pp. 1-7 (including translation).

* cited by examiner

FUSE PROTECTOR WITH A PLURALITY OF FUSES

CROSS REFERENCE TO RELATED APPLICATIONS

This application is a national-stage entry of PCT/CN2015/074655, filed Mar. 20, 2015, which claims priority to Chinese Patent Application No. 201410206784.3, filed May 16, 2014, the contents of all of which are hereby incorporated by reference in their entirety.

TECHNICAL FIELD

The present disclosure relates to the field of an electrical appliance, and in particular, relates to a fuse protector with multiple fuses.

BACKGROUND

A fuse protector is mainly used to protect wires or devices in a power distribution system. That is to say, when fault current occurs in the power distribution system, the fuse protector fuses rapidly to shut off the current so as to prevent the spread of the accident. Currently, the conventional structure of the fuse protector substantially consists of a fuse protector base made of insulating materials, a fuse carrier made of insulating materials, and standard fuses. The fuse protector base comprises fuse protector base contacts contacted with both ends of the fuses, and terminals electrically connected with the contacts. The main function of the fuse carrier is to support the fuses so that the fuses can be easily inserted into or pulled out of the fuse protector base, and can be replaced and maintained conveniently. The fuse protector can be applied in many situations, especially in photovoltaic power generation, since the fuse protector has the advantages of low price, convenient maintenance and so on. As the world pays attention to the environment and strongly supports the renewable energy, the photovoltaic power generation industry has developed rapidly, and thus needs the fuse protector that can satisfy higher requirements, especially on a high pressure, a small volume, high safety and reliability. Many manufacturers of the fuse protector pay attention to these aspects. By market research and comparison of the fuse protectors available from numerous manufacturers, the inventor found that the existing fuse protector in the market have the following drawbacks. First, the distribution box has a low utilization rate of space due to the arrangement of the fuse protectors. Second, it is difficult to mount a leakage module and a Hall module in a photovoltaic combiner box by the existing arrangement of the fuse protectors. And third, the fuse protector generally comprises two breaking points which are applied high pressure during insertion and pulling operation, and an arc may occur and ablate the contact points, thus leading to short lift and poor safety. The specific analysis is as follows.

(1) The distribution box has a low utilization rate of space due to the arrangement of the fuse protectors. The conventional photovoltaic power generation system gathers the electric energy produced by 16 groups of solar panels into a combiner box, and then inputs the electric energy into an inverter. The fuse protectors in the combiner box function to protect the solar panels, and the electric elements and wires in the combiner box, and also to isolate the power source. The current fuse protector applied to the photovoltaic power generation field generally comprises one incoming line terminal and one outgoing line terminal. Two fuse protectors for a positive electrode and a negative electrode so as to protect a circuit under 1000V. Meanwhile, in order to ensure safe electric clearance and creepage distance between the positive electrode and the negative electrode, the positive electrode and the negative electrode are arranged separately from each other in the photovoltaic combiner box, with a large enough safe distance. The current combiner box system with the fuse protector generally has 32 fuse protectors, which are divided into a group for positive electrode and a group for negative electrode, and each group has 16 fuse protectors. Each group is arranged in the combiner box in a modular form. In order to ensure the safe creepage distance and the electric clearance, the two groups are spaced at a certain distance vertically or horizontally. Obviously, the above-mentioned arrangement of the fuse protectors causes a waste of volume of the combiner box and amount of the wires. Meanwhile, the same problem also exists in an alternating current distribution system. Generally, the arrangement of alternating current fuse protectors comprises two forms: one form in which the fuse protectors are individual from each other and each fuse protector has one fuse and two terminals, one for incoming and the other one for outgoing, and the other form in which a plurality of individual fuse protectors are disposed side by side, with the fuse protector bases thereof connected together or formed into an integrity, wherein the fuse protectors have a plurality of terminals, and the fuses are inserted individually for convenient management. The above two forms are the same in volume, but also have a low utilization rate of the space in the power distribution box.

(2) In the photovoltaic combiner box system, in order to monitor the power generation of each branch, a leakage module and a Hall module are generally installed. The leakage module mainly serves to detect whether there is a leakage in each branch. The leakage module detects leakage current by inducing imbalance of the current in the positive and negative electrodes via mutual inductors, which all the positive and negative wires pass through. The Hall sensor mainly detects the current of each branch, and it monitors magnitude of the current based on Hall Effect. In fact, the leakage module and the Hall sensor are formed as a whole respectively. However, when applied to the combiner box system, the fuse protectors for the positive electrode and the fuse protectors for the negative electrode are arranged separately, and each group comprising 16 fuse protectors is arranged at an individual region in the combiner box. If it is necessary to install the leakage module and the Hall sensor, wires needs to be connected to the leakage module and the Hall sensor, thus wasting wires and occupying space.

(3) High pressure is applied to the breaking points during insertion and pulling operation of the fuse, resulting in short lifetime and poor safety of the fuse protector, particularly in the direct current system. The conventional fuse protector either has one fuse protector base cooperated with one fuse, or has a plurality of bases arranged horizontally cooperated with a plurality of independent fuses. Generally, the fuse may be inserted and pulled rotatably or directly. Pulling rotatably means removing one end of the fuse away from a stationary contact and then removing the other end of the fuse, that is, the two ends of the fuse are pulled out in a sequential order. Pulling directly means removing two ends of the fuse directly away from two stationary contacts at the same time. Pulling directly is better than pulling rotatably on the aspects of both the voltage on the breaking point and the breaking velocity. In the photovoltaic direct current system, the voltage is 1000V, and different from the alternate arc, the direct arc has no zero crossing point and is difficult to extinguish. The extinguishing of the direct arc mainly depends on breaking velocity, breaking distance, and number of the breaking points. That is to say, faster breaking velocity, longer breaking distance, and more the breaking points are helpful to the rapid extinguishing of the arc. Multiple breaking points can equally bear the breaking voltage, which is important to arc extinction. From the above analysis, it can be seen that the disadvantage of pulling rotatably is particularly significant. Rotatable separation is to separate one end of the fuse at first from the stationary contact and then separate the other end of the fuse from the stationary contact, and thus the operation speed is lower than that of pulling directly. Besides, there is only one breaking point, and the voltage applied to the breaking point is very high, thus it is difficult for the arc to be extinguished, particularly in high altitude area where the arc cools slowly due to the thin air. Since the photovoltaic power station project always chooses high altitude area due to plenty of sunshine thereof, it is necessary to solve the technical problem of preventing the arc from ablating the contact position. The ablation of the arc affects the electrical conductivity and lifetime of the fuse protector, or threatens the safety of the operator, which will bring serious consequences. For pulling directly, there are two breaking points equally bearing the breaking voltage. The fuse protector adopting the way of pulling directly has more advantages than the fuse protector adopting the way of pulling rotatably due to a higher operation speed. The combustion of the arc greatly affects the contact position even if there are two breaking points.

SUMMARY

In order to solve the above problems effectively, the present disclosure provides a fuse protector, wherein two or more fuses or the combination of fuses and current carrying component are aligned vertically in one fuse carrier. The two fuses in one fuse protector can respectively connect to a positive electrode and a negative electrode. It is not necessary to provide a positive fuse protector and a negative fuse protector individually, thus significantly increasing a utilization rate of space in a power distribution box and being capable of conveniently cooperating with a leakage module and a Hall module under the premise of safety. Meanwhile, when the fuse carrier is pulled out of the fuse protector base, at least four breaking points are generated at the same time, thus significantly improving the safety and reliability of the system.

The present disclosure provides a fuse protector, comprising a fuse protector base, a fuse carrier inserted in the fuse protector base, and fuse elements provided on the fuse carrier;

the fuse protector base, at least two wiring assemblies are provided on one side of the fuse protector base, and at least two wiring assemblies are provide on the other side of the fuse protector base opposite to the one side, wherein each of the wiring assemblies on the one side corresponds to each of the wiring assemblies on the other side in position, the fuse protector base is further provided with a plurality of base contacts, and each of the wiring assemblies is connected with one base contact corresponding thereto in position, the wiring assemblies are insulated one from another, and the combinations of the corresponding wiring assemblies on the one side and on the other side are aligned vertically, and the base contacts corresponding to their respective combinations are aligned vertically;

the fuse carrier, which is provided with at least two groups of cavities in which the fuse elements can be placed, the groups of cavities are aligned vertically and correspond to the fuse protector base contacts in position, and when the fuse carrier is pulled out of the fuse protector base, at least four breaking points are formed; and the fuse elements, the number of the fuse elements is at least two, and the fuse elements are provided in the cavities of the fuse carrier, and after the fuse carrier is inserted in the fuse protector base, the fuse elements are electrically connected with the base contacts.

Further, the at least two fuse elements are chosen from a groups consisting of pure fuse, a combination of the fuse and a current carrying component, or a combination of the fuse and a current carrying fuse components.

Further, the fuse is formed in a shape of cylinder, wherein two ends of the fuse are formed as electric conductors, a middle portion of the fuse is formed as an insulator, and a fusible core capable of carrying current and providing over current fusing protection is provided inside the fuse; and the current carrying component is formed in a shape of cylinder, wherein two ends of the current carrying component are formed as electric conductors, a middle portion of the current carrying component is formed as an insulator, and a conductor capable of carrying current yet without fusing function is provided inside the current carrying component.

Further, the wiring assemblies on the one side of the fuse protector base are provided as incoming line terminals and the wiring assemblies on the other side of the fuse protector base are provided as outgoing line terminals.

Further, side surfaces of the fuse protector base are formed in a planar shape, two adjacent incoming line terminals are arranged diagonally, and two adjacent outgoing line terminals also are arranged diagonally, and a plastic rib, a notch, or the combination of plastic rib and notch are provided around the incoming line terminals and the outgoing line terminals.

Further, the side surfaces of the fuse protector base are formed in a stepped shape.

Further, each of the base contacts of the fuse protector comprises an elastic member and a contact body made of metal materials.

Further, the fuse carrier is provided with a handle on one end.

Further, the fuse carrier is provided with at least one device for indicating fusing in the fuse protector.

Further, the number of the fuse elements is two, and the number of the wiring assemblies on the one side or on the other side of the fuse protector base is two.

The beneficial effect of the present disclosure lies in that the fuse protector using two fuses can generate four breaking points during insertion and pulling of the fuses. The voltage of the arc are equally divided to four breaking points, effectively reducing the voltage and energy of the arc applied on each breaking point, and better protecting the contact points of the base contacts and the fuses. As compared with the conventional fuse protector with a single fuse, the energy of the arc applied to each contact point is reduced by a half. The advantage of this technical solution is particularly outstanding in the application under 1000V of direct current. Besides, the fuse protector with two fuses has a width the same as that of the conventional fuse protector, and thus can reduce the width by a half as compared to the total width of two fuse protectors with a single fuse. The fuse protector with two fuses is better than the fuse protector with a single fuse in the aspects of both manufacturing cost and operational reliability or the volume.

DETAILED DESCRIPTION

Figure 1:
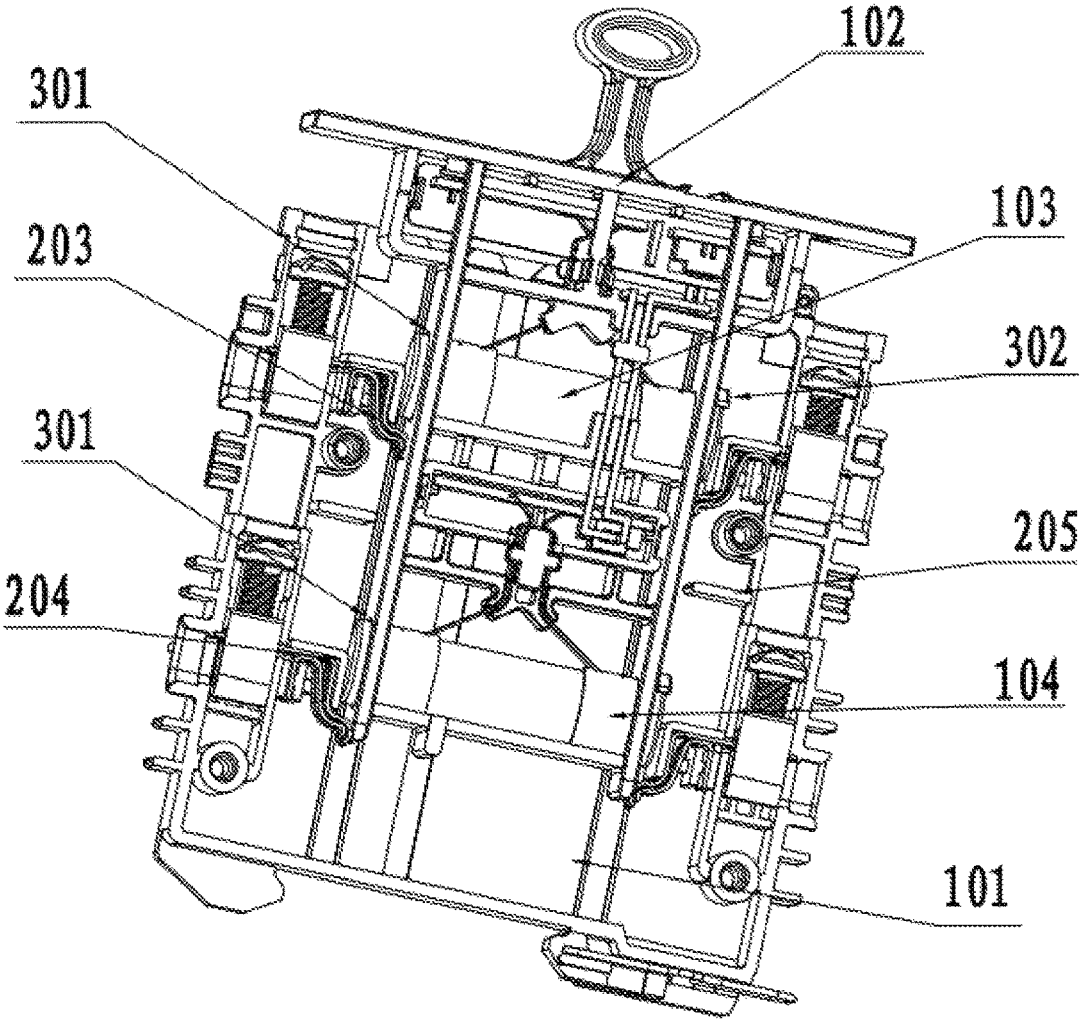
FIG. 1 is a schematic view of a structure of Example 1 of the present disclosure.

To achieve the above object, specific embodiments of the present disclosure will be further described by referring to the accompany drawings.

Example 1

As shown in FIGS. 1-5, a fuse protector in this example comprises a fuse protector base 101, a fuse carrier 102, and fuses 103. The fuse protector base 101 is formed by snap-fitting a cover and a base made of insulating plastic materials. The fuse protector base is provided with two incoming line terminals 201 and two outgoing line terminals 202 therein. The two incoming line terminals 201 respectively correspond to the two outgoing line terminals 202 in position, forming two groups of the incoming line terminals 201 and the outgoing line terminals 202, and each group includes one incoming line terminal 201 and one outgoing line terminal 202 corresponding to each other in position. Besides, the two groups of the incoming line terminals 201 and the outgoing line terminals 202 are aligned vertically, and the incoming line terminals 201 and the outgoing line terminals 201 are insulated from each other. Four base contacts 203, each of which corresponds to each of the incoming line terminals 201 and the outgoing line terminals 202, are further provided in the fuse protector base 101. The fuse carrier 102 is made of insulating plastic, and has a handle 303 for operating provided on a top portion thereof. The fuse carrier 102 further comprises cavities 301 aligned vertically for receiving the fuses 103 therein. The fuses 103 inserted into the cavities 301 have a direction perpendicular to a direction on which the fuse carrier 102 is inserted into the fuse protector base 101, and also keep a certain distance from each other to be insulated from each other. The cavities 301 have a shape matching with that of the fuses 103. Said fuses 103 are formed in a shape of cylinder. The cavities 301 have a slightly larger size than the fuses 103, so that the operators can replace and maintain the fuses 103 conveniently. Each of the cavities 301 is provided with a protrusion 302 for blocking the fuses 103 in the cavities 301 so as to prevent the fuses 103 from departing from the fuse carrier 102. After the fuse carrier 102 is inserted in the fuse protector base 101, both ends of each fuse 103 are in contact with the corresponding base contacts 203, forming a closed state between the fuses 103 and the base contacts 203. After the fuse carrier 102 is pulled out, both ends of each fuse 103 are departed from the base contacts 203 inside the fuse protector base 101.

For the fuse protector with two fuses, there should be enough electric clearance between conductive components, that is, a minimal spacing and creepage distance between two conductive components, or a minimal distance between insulating surfaces of the two conductive components. According to requirements of UL489 standards, a creepage distance between terminals of two polarities should be more than 50.8 mm. A minimal distance between two components of opposite polarities without insulator is 9.5 mm. Regarding this aspect, following technical solutions are adopted.

Figure 2:
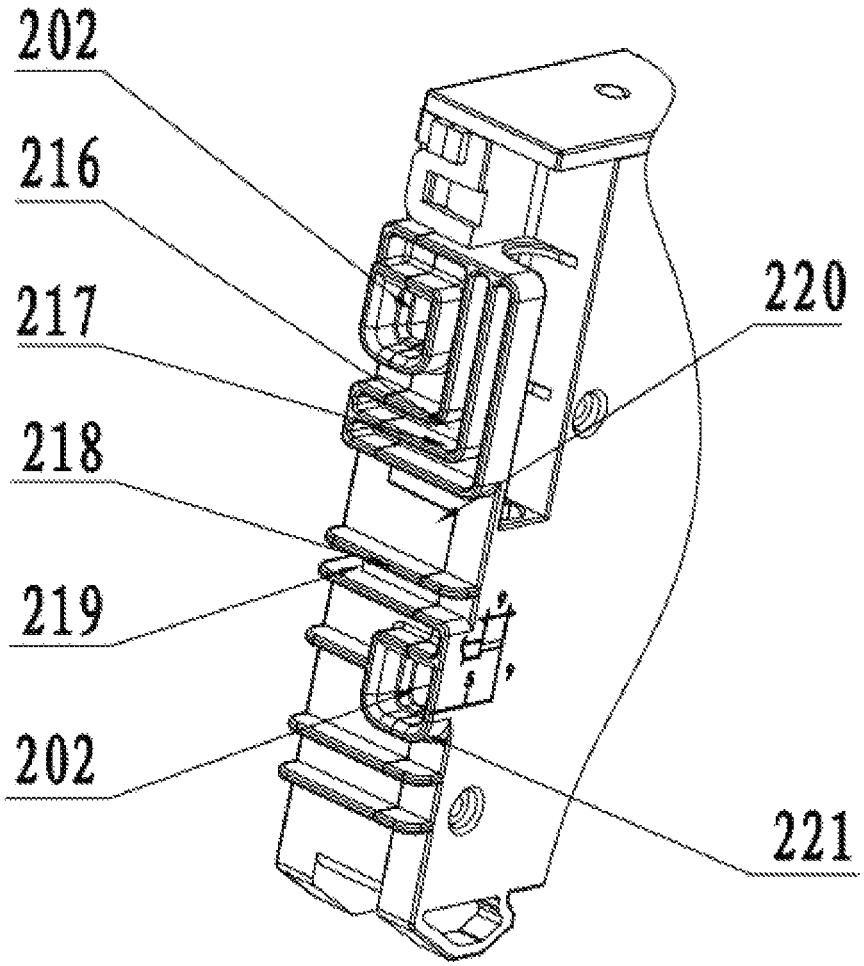
FIG. 2 is a schematic view of a side structure of a fuse protector base of the present disclosure.

(1) The incoming line terminals 201 on one side of the fuse protector base 101 or the outgoing line terminals 202 on the other side of the fuse protector base 101 are disposed diagonally, so as to obtain a maximum distance within a limited volume. Taking the outgoing line terminals 202 as an example, as shown in FIG. 2, the outgoing line terminals 202 are located at two diagonally opposite positions of the fuse protector base 101. The electric clearance between the terminals of the same polarity can reach to 34 mm, and the electric clearance between the terminals of different polarities is 31.7 mm. The minimum electric clearance is 21.7 mm during the insertion and pulling of the fuse carrier 102, which is safer than 9.5 mm prescribed by UL standard by a level of 12.2 mm.

(2) As shown by FIG. 2, a plurality of plastic insulating walls (217, 218, and 221) and a notch 219 are provided between the incoming line terminals 201 or the outgoing line terminals 202 on the same side so as to achieve a maximum creepage distance in limited relative space. As shown by FIG. 2, five plastic insulating ribs are provided, with a height restricted to 3.5 mm. A bottom surface 216 on an inner side of the ribs is 0.5 mm lower than a bottom surface 220 on an outer side of the plastic insulating walls. Two insulating walls 218 are provided above the lower incoming line terminal 202, and the notch 219 is located on one side of the two insulating walls 218. A wall 221 is provided surrounding a single incoming line terminal 201 or a single outgoing line terminal 202. The above technical solution can maximize the creepage distance in a limited volume without affecting shaping process and strength. A special structure is also provided between different polarities inside the fuse protector. A plastic rib 205 is provided between the base contacts 203 on the same side of the fuse protector base 101, and a rectangular style plastic rib 204 is provided above each of the base contacts 203 for isolation, thus ensuring a safe creepage distance between different polarities and increasing the safe electric clearance during insertion and pulling of the fuse carrier 102. By arranging the notch and the plastic walls properly, the creepage distance between the incoming line terminals 201 or the outgoing line terminals 202 on the same side reaches to 53 mm, which is larger than 50.8 mm prescribed by UL standard.

Figure 3:
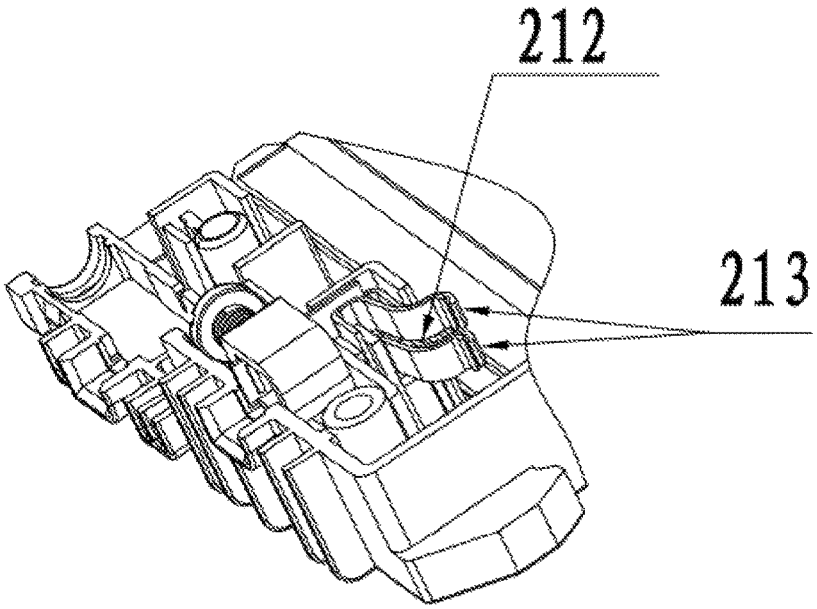
FIG. 3 is a schematic view of a structure of base contacts of the present disclosure.
Figure 4:
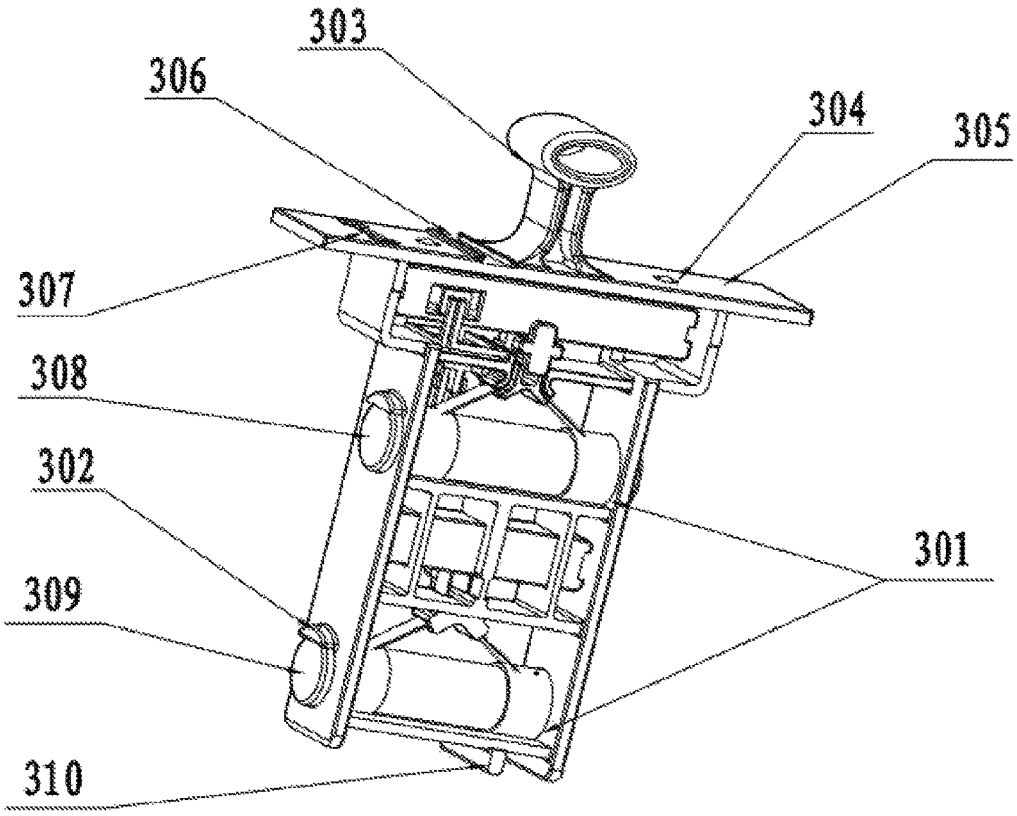
FIG. 4 is a schematic view of a structure of a fuse carrier of the present disclosure.
Figure 5:
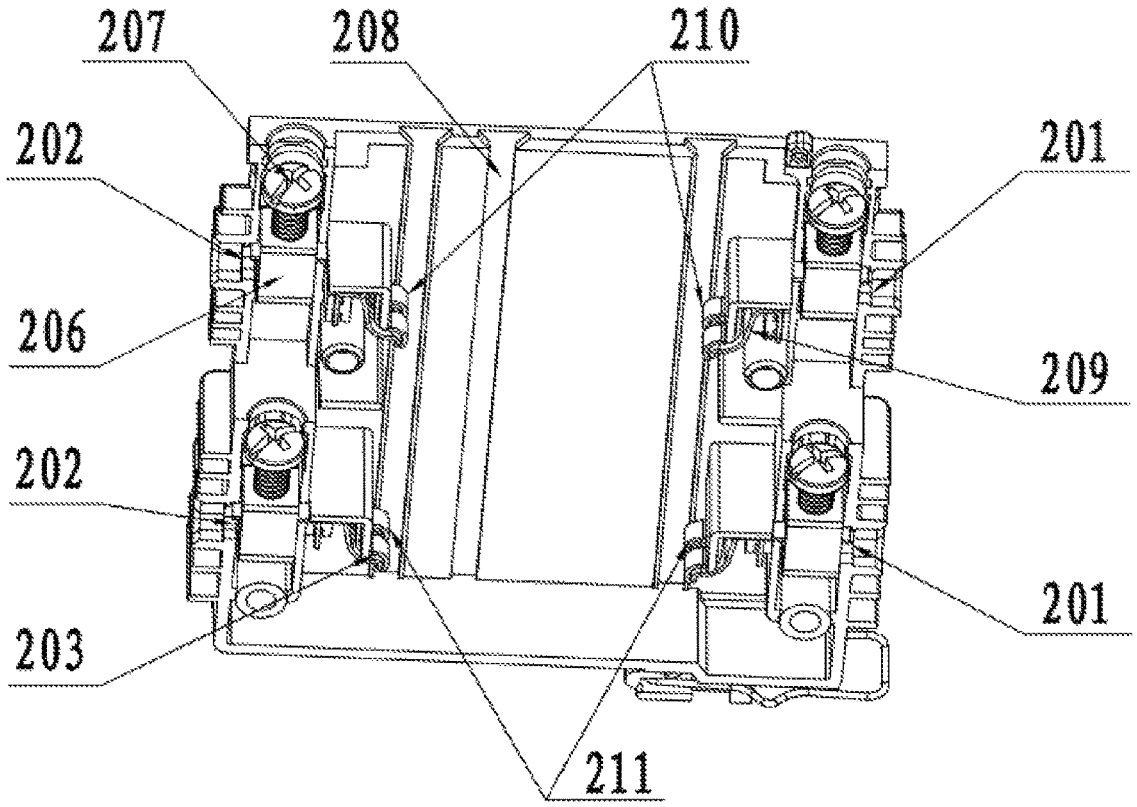
FIG. 5 is a schematic view of a structure of the fuse protector base of the present disclosure.

The fuse protector 101 is made of insulating material. Each of the incoming line terminals 201 and the outgoing line terminals 202 is provided with a terminal base 206 and a terminal screw 207. Each of the base contacts 203 is provided with a contact body 213 made of copper with good electrical conductivity and an elastic member 209 made of metal with good elasticity. The elastic member 209 is arranged on a back portion of the contact body 213, and serves to support the contact body 213 and also to increase the pressure on the contacts, ensuring a reliable contact. The contact body 213 is provided with an opening 212 on a front end. The terminal base 206, the terminal screw 207, the contact body 213 and the elastic member 209 form a connector structure. As shown by FIG. 3, the front end of the contact body 213 is divided into two parts by the opening, so that there are two contact points in one contact position, thus further improving the contact reliability. Positions of the connector structures correspond to each other in a vertical direction, and the upper connector structures are connected with either one of a positive wire and a negative wire (in other words, L electrode and N electrode), and the lower connector structures are connected with the other one. Four base contacts 203 are arranged in the fuse protector base 101.

When the fuse protector is switched on, the fuse carrier 102 with the fuses 103 mounted within the cavities 301 is inserted in the fuse protector base 101. To avoid wrong operation of the operators, the fuse carrier 102 is provided with a boss 310 on a position close to a center thereof, and correspondingly the fuse protector base 101 is provided with a slot 208 corresponding to the boss on a position close to a center thereof so as to avoid anti-insertion. When the fuse carrier 102 is inserted into the fuse protector base 101, at first, two axial end surfaces 309 of a first fuse 103 come into contact with circular positions 210 of a second group of the base contacts 203 disposed on both sides of the fuse protector base 1. At this moment, the whole circuit is not switched on. Continuing the insertion of the fuse carrier 102, the two axial end surfaces 309 of the first fuse 103 pass over the circular positions 210 of the second group of the base contacts and come into contact with the circular positions 211 of a first group of the base contacts. Meanwhile, two axial end surfaces 308 of a second fuse enter the base and come into contact with the circular positions 210 of the second group of base contacts. At this moment, the whole circuit is switched on. Before the switching on, arc may occur. The size of the arc depends on the actual current and voltage of the whole circuit. The larger the current and voltage, the larger the arc. The positions in which the fuse protector base contacts 203 and the fuses 103 are contacted with each other may be ablated by the arc, thus leading to unreliable contacts. The whole fuse protector may be ruined in some severe cases. In order to solve the technical problem of the ablation of the arc, it is necessary to make improvements on inserting velocity of the fuse carrier and the number of the contact points during insertion of the fuse carrier. Regarding the inserting velocity, the current operation manners of the fuse protectors are similar, and thus it is better to make improvements on the number of the contact points during insertion of the fuse carrier. The fuse protector with two fuses of the present disclosure achieves four breaking points during insertion and pulling of the fuses. The voltage of the arc is equally divided into four contact points to reduce the voltage and energy of the arc effectively and to better protect the contact points of the base contacts 203 and the fuses 103. As compared to the conventional fuse protector with a single fuse, the energy of the arc for each contact point reduces by a half. The advantage of the technical solution is particularly outstanding in the applications with 1000V of direct current. Moreover, the fuse protector with two fuses 103 has a same width as the conventional fuse protectors, and has a half width of two fuse protectors with a single fuse. The fuse protector with two fuses has more advantages than the fuse protector with a single fuse on a manufacturing cost, an operational reliability and a volume. The fuse protector with two fuses has more advantages than the fuse protector with a single fuse on wiring connection and arrangement, when applied to a combiner box of 1000V comprising a leakage module and a Hall sensor. The leakage module is formed by 16 groups of mutual inductors and a circuit board matched with them, and has a width similar to a total width of 16 fuse protectors. It's true of the Hall sensor, as well. A fuse protector with two fuses is used to be cooperated with the leakage module and the Hall sensor, and directly connected with them without too many wires. The common fuse protectors arranged in the combiner box comprise two parts: one part comprises 16 fuse protectors connected with a positive electrode, and other part also comprises 16 fuse protectors connected with a negative electrode. The two parts comprises 32 fuse protectors totally. It is a relative troublesome thing to arrange the above leakage module and Hall sensor in such situation. The fuse protector with two fuses can solve this problem. It will be unnecessary to arrange the fuse protectors with two fuses into one part connected with the positive electrode and other part connected with the negative electrode. 16 fuse protectors can be directly arranged in a row and conveniently connected with the leakage module and the Hall sensor.

Example 2

Regarding the fuse protector with two fuses in Example 1, any one of the two fuses can be replaced by a current carrying component without fusing function. Specific implementations are described as below. The current carrying component is formed in a shape of cylinder, wherein both ends of the current carrying component are formed as electric conductors 501, and a middle portion of the current carrying component is formed as an insulator 502. A conductor 503 capable of carrying current yet without fusing function is provided inside of the current carrying component. The conductors 503 without fusing function is made of copper wire with excellent conductivity, with an effective conductive sectional area much larger than a fusible core of the fuses and a overall internal resistance much smaller than the fuses. The metal wire is arranged inside the insulator 502, and both ends of the metal wire are electrically connected with the conductor metal caps 501. The conductor metal caps 501 are fixed at both ends of the insulator 502, have a same shape and size as the fuses, and can be placed into any one of the two cavities 301 of the fuse carrier 102 like the fuses, for carrying current. In an implementation, the current carrying component 104 can be molded in the fuse carrier in advance. And in this implementation, it is unnecessary to form the current carrying component 104 in a same shape as the fuse carrier 103, and the current carrying component 104 can have a different shape from the fuse carrier 103, as long as it has conductive sections on both ends like the fuses 103. Since the current carrying component 104 has no fusing function, it is unnecessary to maintain and replace it. Thus, the current carrying component 104 can be molded in any position of the two cavities 301 in the fuse carrier 102 in advance, and the operator only needs to maintain one fuse 103. The implementation has the following beneficial effects.

(1) An internal resistance of the fuse protector can be decreased. Since fusion of the fuses 103 is caused by a temperature rise of the fuse due to a heating effect of the current. Due to the temperature rise, the fuses melt and break, and thus breaking the current. This technical solution has high requirements on the internal resistance and the melting point of the fuse, so as to achieve accurate break-time of over current protection. Generally, the fuse has a high internal resistance, and it heats even in normal use, resulting in excessive loss of the electric energy. By replacing any one of the fuses 103 in the fuse protector with the above current carrying components 104, the power consumption of the fuse protector can be much lowered, the electric energy consumption of the fuse protector can be decreased effectively, and the heat generation during usage also can be reduced.

(2) The cost of the fuses can be saved. One fuse comprises an insulating tube, the conductive metal caps on the ends, metal fuse wires, and mediums for cooling (silica sand). The current carrying component basically comprises the same parts as the fuse. However, since the current carrying component is not fusible, it does not need to be filled with cooling medium. Moreover, the metal fuse wire is replaced by cheap copper wire in the current carrying component, and thus the manufacturing cost can be reduced. From the use of users, since overload or short-circuit often occur in the system, the fuses need to be replaced frequently. In this Example, which comprises one fuse and one current carrying component, the current carrying component cannot be fused. Thus, only one fuse needs to be replaced once, so that usage cost of the users can be greatly reduced.

Example 3

According to the technical solution containing the current carrying component in Example 2, the current carrying component also can be a current carrying fuse component, which has rated current larger than the rated current of the circuit. The rated current of the current carrying fuse component is higher than the rated current of the circuit or the fuses by more than 4 times. If the current carrying fuse component has a rated current higher than the fuse, then it has a fusing current higher than that of the fuse 103. The current carrying fuse component has an internal resistance lower than that of the fuse 103, and when an overload or short-circuit occurs, the current carrying fuse component will not be fused at first. In the normal current, the current carrying fuse component will not heat and has lower power consumption. The current carrying fuse component has almost the same effect as the above-mentioned current carrying component. In a power distribution system, regarding the stage difference coordinate of the fuses, the rated current of a superior fuse protector should be generally higher than the rated current of a junior fuse protector by 1.6 times, so that a overstep fusing will not occur. However, the stage difference coordinate is closely related to a resistance of the entire loop, a magnitude of short-circuit current, environmental temperature and so on. In practice, for the purpose of safety, the rated current of the superior fuse protector should be generally higher than the rated current of the junior fuse protector by 2-3 times. In order that the current carrying fuse component will not be fused by a high short-circuit current, a larger allowance should be left when designing. Meanwhile, through numerous stage difference coordinate tests, the rated current of the current carrying fuse component shall be larger than that of the fuse by more than 4 times, ensuring that the current carrying component will not heat during normal running and not be fused if a short-circuit occurs.

The above two Examples, both the fuse protector with two fuses and the fuse protector with one fuse cooperated with one current carrying component, have their respective advantages. For example, in the case that it is necessary to break a high limited short-circuit current, the fuse protector with two fuses is better than the fuse protector with one fuse cooperated with one current carrying component, especially in a photovoltaic direct current power generation system, wherein a capacity of the battery is especially large, and the short-circuit current is also very high and is even close to or exceeds the rated short-circuit breaking capacity of fuse protector. In this case, the fuse protector with one fuse cooperated with one current carrying component has only one fusing point, while the fuse protector with two fuses has two fusing points. With two fusing points, the fuse protector has a much higher breaking capacity, even higher than the rated short-circuit breaking capacity of the fuses themselves. As can be seen from the above, in the aspect of cost saving, the fuse protector with one fuse cooperated with one current carrying component is better than the fuse protector comprising two fuses. In the aspect of high breaking capacity, the fuse protector comprising two fuses is better than fuse protector with one fuse cooperated with one current carrying component. According to the above description and analysis of the solutions, the fuse protector with two fuses of the present disclosure can be applied to many applications through various modifications to the above implementations, has advantages of high performance, high reliability, low cost and so on, and also can save space. The fuse protector with two fuses of the present disclosure makes an unprecedented breakthrough in the application of the fuse protection.

Example 4

Figure 6:
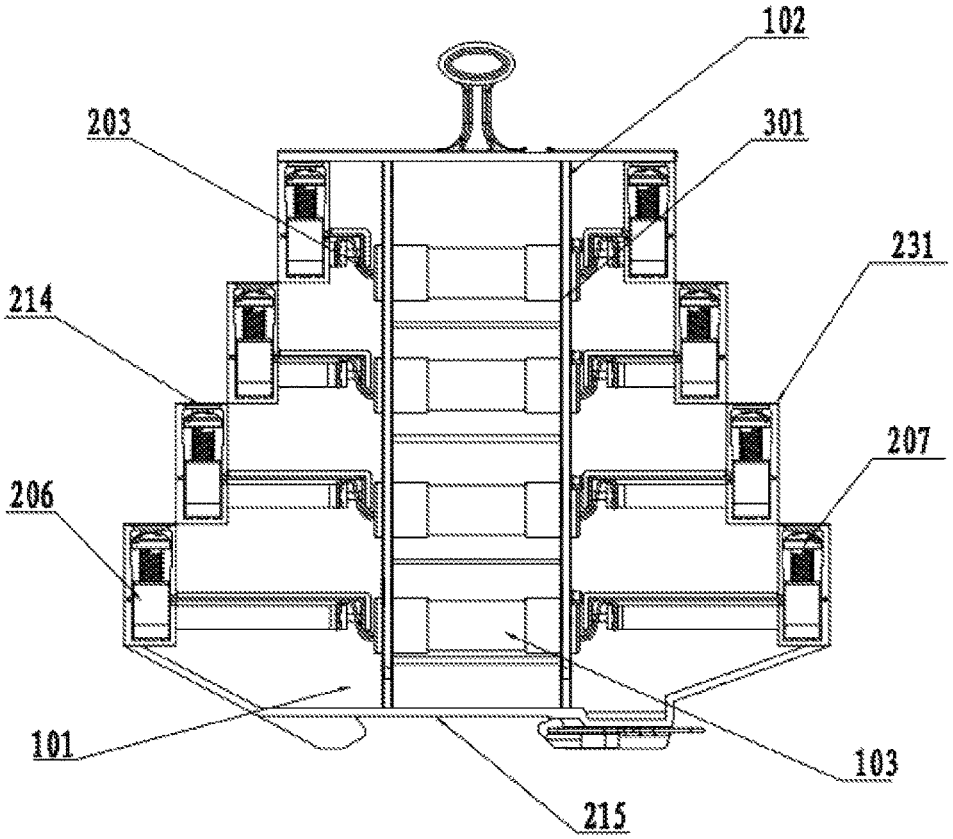
FIG. 6 is a schematic view of a structure of Example 4 of the present disclosure.
Figure 7:
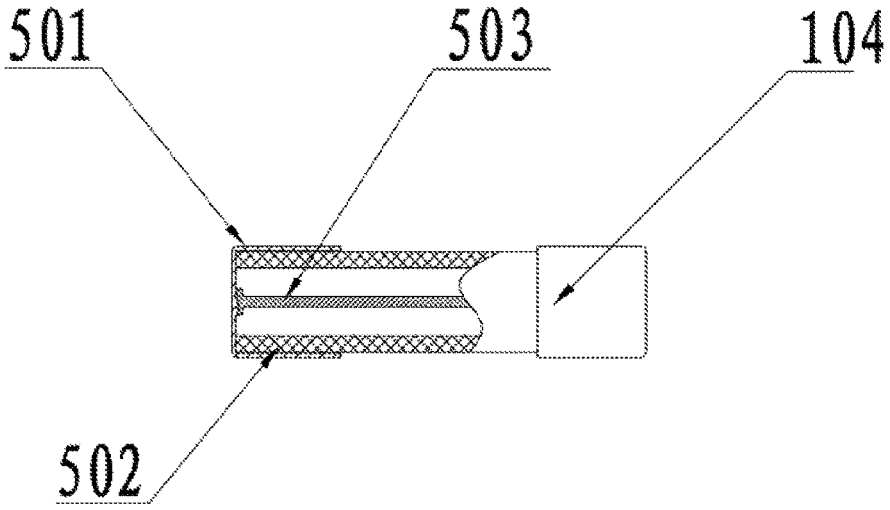
FIG. 7 is a schematic view of a structure of a current carrying component of the present disclosure.

As shown by FIG. 6, the Example provides a fuse protector with a plurality of fuses applied in a three-phase alternating current circuit or a three-phase four-wire circuit. The specific implementations are set forth as blow. Three or four groups of fuse protector base contacts 203 are provided in the fuse protector base. The fuse carrier 102 comprises three or four cavities 301 in which the fuses can be placed. The fuse protector base 101 comprises three or four steps 231 on each side where connector structures are placed. In each step 231, an incoming line terminal 201 or an outgoing line terminal 202 and a fuse protector base contact 203 are provided. Multiple incoming line terminals 201 or multiple outgoing line terminals 202 are staggered in the vertical direction in the steps 231 of the fuse protector base 101. A circular hole 214 is provided on each of the three or four steps 231 parallel to a mounting surface 215. A screwdriver can be inserted into the circular hole for connecting wirings. The connector structures for the incoming line terminals or that for the outgoing line terminals are aligned in a line. The base contacts 203 closest to the mounting surface 215 of the fuse protector is longest and furthest away from the connector structure, and the base contacts 203 furthest away from the mounting surface 215 is closest to the connector structure, and so on. Such an arrangement solves the wiring and installation of the fuse protector with more than 3 fuses. The implementations of the fuse carrier 102 in the fuse protector with multiple fuses is similar to that of the fuse carrier in the fuse protector comprising two fuses described by Example 1. The difference lies in that, in the fuse carrier of the fuse protector with multiple fuses, the distance between each group of fuse protector base contacts 203 in the fuse protector with multiple fuses needs not to be so large. It is because that the fuse protector with 3 or 4 fuses mainly is applied for alternating current of 400V, and the requirements in creepage distance and electric clearance are not as high as that under direct current of 1000V. The operation method and process of the fuse protector with multiple fuses are basically the same as that of the fuse protector with two fuses described by Example 1. When the fuse carrier 102 is inserted into the fuse protector base 101, at first, the fuse 103 at the forefront end of the fuse carrier 102 enters the fuse protector base 101 and both ends of this fuse 103 comes into contact with the fuse base contacts 203 of the base closest to the insertion port, and then this fuse 103 passes over the fuse base contacts 203 of the base closest to the insertion port and comes into contact with the next group of base contacts 203. When the first fuse 103 comes into contact with the next group of fuse protector base contacts 203, the second fuse 103 on the fuse carrier 102 comes into contact with the fuse protector base contact 203 closest to the insertion port, and so on. When the fuse carrier 103 is inserted to a bottom of the fuse protector base 101, the first fuse 103 comes into contact with the lowermost group of fuse protector base contacts 203, meanwhile both ends of all other fuses 103 come into contact with their corresponding fuse protector base contacts 203, and all on the circuits are switched on. The fuse protector with three or more fuses has the same width as the fuse protector with a single fuse, and has a slightly increased length and height, and thus makes some improvements on both saving the volume and the manufacturing cost of the fuse protector.

Figure 8:
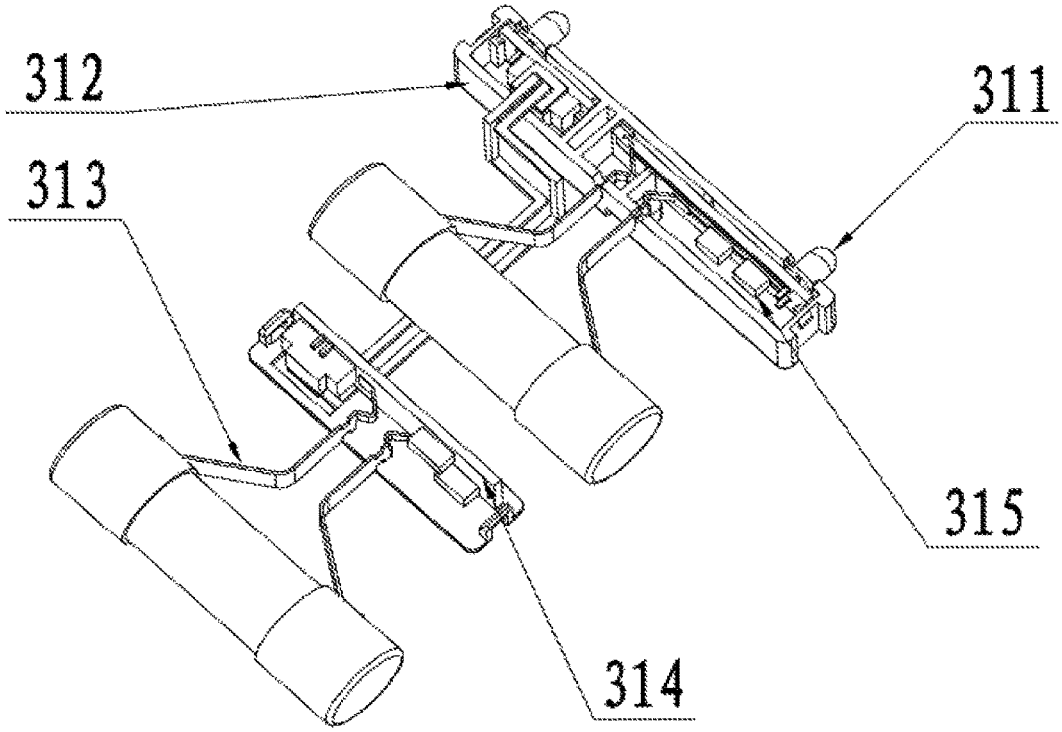
FIG. 8 is a schematic view of a structure of a device for indicating the fuse protector.
Figure 9:
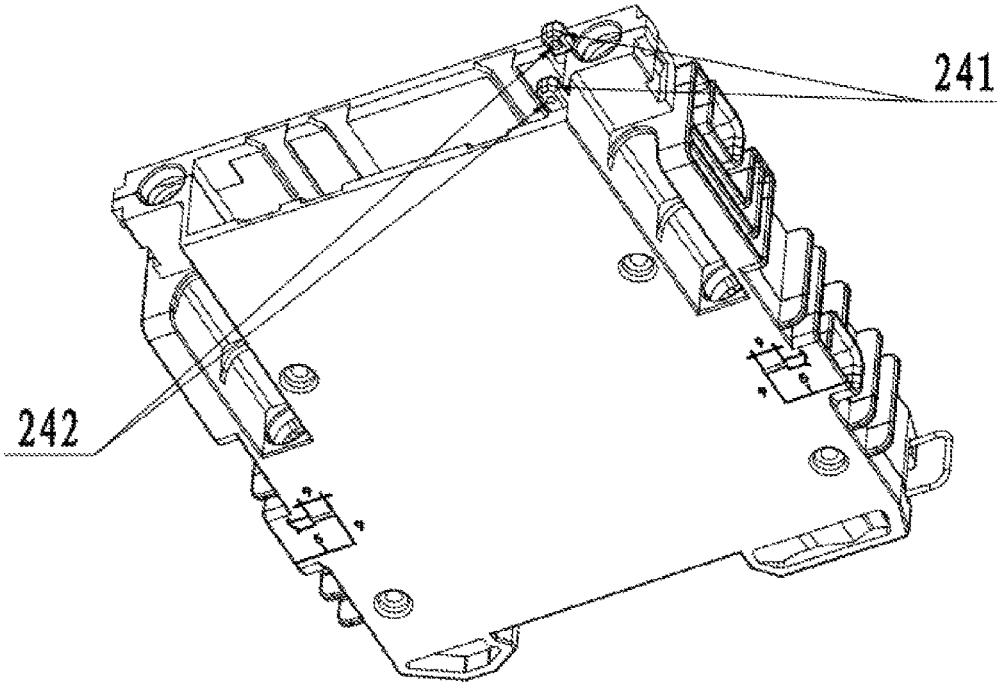
FIG. 9 is a schematic view of a structure of a position clocking mechanism for a handle of a fuse protector of present disclosure.

Based on the above Examples 1 to 4, the fuse protector with multiple fuses of the present disclosure further comprises an indicating device mainly for indicating whether the fuses 103 are fused or not. As shown by FIG. 8, the device for indicating fusing comprises an electric resistance 315, a light emitting diode 311, a printed circuit board 314, and a pick power contacting spring pieces 313, and is placed in an insulating plastic box 312 after being assembled. Then, the box 312 is fixed on the fuse carrier 102. The electric resistance 315 and the light emitting diode 311 are fixed on the circuit board 314 in series. The whole circuit is connected with both ends of the fuses 103 by the pick power contacting spring pieces 313 to connect the series combination of the light emitting diode 311 and electric resistance 315 with the fuse 103 in parallel. When the fuse 103 is fused, since the spring pieces 313 of the indicating device is in contact with both ends of the fuse 103 and current flows through the electric resistance 315 and light emitting diode 311, a conductive path is formed and the light emitting diode 311 is lightened. When the fuse 103 works fine, since the internal resistance of the fuse 103 is much less than that of the series combination of the light emitting diode 311 and the electric resistance 315, current only flows through the fuse 103 while not through the series combination of the light emitting diode 311 and the electric resistance 315, and the light emitting diode 311 cannot be lightened. Thus, it can be indicated whether the fuse 103 is fused or not, and thus it is convenient for the maintainer to correctly judge which fuse is fused.

According to the above Examples 1-4, the number of the indicating device of the present disclosure can be one or more. Example 1 relates to a fuse protector with two fuses. In this case, it is necessary to provide two devices for indicating fusing. In the implementations where two devices for indicating fusing are provided, the pick power spring pieces 313 are provided at both ends of each fuse 103. The pick power spring pieces 313 connect the series combination of the light emitting diode 311 and the electric resistance 315 to the both ends of each fuse 103 in parallel. In practice, the two fuses 103 may be fused not simultaneously due to the factors such as electric resistance of the wirings, and manufacture error of the fuses, during the over-current protection. Since the indicating devices are connected to the both ends of their respective fuses 103, and thus can merely indicate the fuse have been fused. If both the fuses 103 are fused, both the indicating lights will be lightened. According to this technical solution, it can be specifically determined which fuse is fused, and as a result, the operators can be informed of the failure location and the failure can be solved rapidly.

According to Examples 2 and 3, the fuse protector with two fuses comprises one fuse 103 and one current carrying component 104. In this technical solution, only one indicating device for the fuse protector is needed to be connected in parallel with the fuses 103 with fusing function to achieve indicating of the fusing. Since the current carrying component has no fusing function, it is unnecessary for the current carrying component to be provided with a device for indicating fusing.

According to the above Examples 1 to 4, the fuse protector with multiple fuses of the present disclosure comprises a "position locking mechanism" for the fuse carrier. In the structure, two bumps 241 are provided at one end of the fuse protector base 101, and each of the bumps 241 is provided with a circular hole 242. A panel 305 of the fuse carrier 102 is provided with a feature combination 307 of two holes and a slot passing between the two holes. After the fuse carrier 102 is inserted in the fuse protector base 101, the two bumps 241 on the fuse protector base 101 pass through the two holes in the fuse carrier 102 and are exposed from the panel 305 of the fuse carrier. Then, the "position locking mechanism" is applied to the two holes 242 on the exposed bumps 241 on the fuse protector base. At this moment, the fuse carrier 102 will be firmly fixed in the fuse protector base 101. The locking mechanism needs specialized keys or tools to be opened, so as to avoid misoperation of the unauthorized person.

The fuse protector with a plurality of fuses of the present disclosure further comprises the following configurations. The panel is provided at one end of the fuse carrier 102. The panel 305 is provided with an ergonomic operating handle 303. The handle 303 and the fuse carrier 102 are integrally formed. A head portion of the handle is in a shape of a transverse ellipse. I-shaped structure on the panel 305 of the fuse carrier is connected with the head portion of the transverse ellipse, with connection positions formed as smooth circular arc. The transverse ellipse has a beautiful appearance, and is adapted for being held by fingers. The I-shaped structure can bear a larger force with a higher stability in the case of limited materials. The smooth circular arcs for connection at both ends of the I-shaped structure make the appearance beautiful, and also can disperse stress to increase the strength.

The fuse protector with multiple fuses of the present disclosure further comprises the following configurations. A slot 306 for inserting a tag is further provided on the panel 305 of the fuse carrier. The slot 306 is a dovetail slot. The tag paper is inserted into the dovetail slot, and fixed, thus not easily falling off. The technical solution can be used to label the serial number of each fuse protector clearly, so that the operator will manage and maintain more conveniently.

What is claimed is:

1. A fuse protector, comprising a fuse protector base, a fuse carrier configured to be inserted into and pulled out of the fuse protector base linearly, and fuse elements provided on the fuse carrier, wherein:

the fuse protector base comprises at least two incoming line terminals on one side of the fuse protector base and at least two outgoing line terminals on an opposite side of the fuse protector base, each outgoing line terminal corresponding to one of the incoming line terminals in position, the fuse protector base further comprises a plurality of base contacts, and each of the incoming and outgoing line terminals is connected with one base contact corresponding thereto in position, the terminals are insulated one from another, and groups of the incoming line terminal on the one side and the corresponding outgoing line terminal on the opposite side are aligned vertically, and the base contacts corresponding to their respective groups are aligned vertically;

the fuse carrier comprises at least two groups of cavities in which the fuse elements can be placed, the groups of the cavities are aligned vertically and correspond to the fuse protector base contacts in position, and when the fuse carrier is pulled out of the fuse protector base, at least four breaking points are formed at the same time; and the fuse carrier comprises at least two fuse elements, and the fuse elements are provided in the cavities of the fuse carrier, and after the fuse carrier is inserted in the fuse protector base, end surfaces of the fuse elements are electrically connected with the base contacts; and wherein the side surfaces of the fuse protector base are formed in a stepped shape, and each side surface of the fuse protector base comprises a number of stepped portions, the number of which corresponds to that of the fuse elements, and the incoming line terminals and the outgoing line terminals are disposed within the respective stepped portions.

2. The fuse protector according to claim 1, wherein the at least two fuse elements are chosen from a group consisting of pure fuse, a combination of the fuse and a current carrying component, or a combination of the fuse and a current carrying fuse component.

3. The fuse protector according to claim 2, wherein the fuse is formed as in a shape of cylinder, wherein two ends of the fuse are formed as electric conductors, a middle portion of the fuse is formed as an insulator, and a fusible core capable of carrying current and providing over current fusing protection is provided inside the fuse; and the current carrying component is formed as in a shape of cylinder, wherein two ends of the current carrying component are formed as electric conductors, a middle portion of the current carrying component is formed as an insulator, and a conductor capable of carrying current yet without fusing function is provided inside the current carrying component.

4. The fuse protector according to claim 1, wherein side surfaces of the fuse protector base are formed in a planar shape, two adjacent incoming line terminals are arranged diagonally, and two adjacent outgoing line terminals also are arranged diagonally, and a plastic rib, a notch, or the combination of plastic rib and notch are provided around the incoming line terminals and the outgoing line terminals.

5. The fuse protector according to claim 1, wherein each of the base contacts of the fuse protector comprises an elastic member and a contact body made of metal materials.

6. The fuse protector according to claim 1, wherein the fuse carrier is provided with a handle on one end.

7. The fuse protector according to claim 1, wherein the fuse carrier is provided with at least one device for indicating fusing in the fuse protector.

8. The fuse protector according to claim 1, wherein the fuse carrier has exactly two fuse elements, the fuse protector base has exactly two incoming line terminals on the one side, and the fuse protector base further has exactly two outgoing line terminals on the opposite side.

9. A fuse protector, comprising a fuse protector base, a fuse carrier configured to be inserted into and pulled out of the fuse protector base linearly, and fuse elements provided on the fuse carrier, wherein:

the fuse protector base comprises at least three incoming line terminals on one side of the fuse protector base and at least three outgoing line terminals on an opposite side of the fuse protector base, each outgoing line terminal corresponding to one of the incoming line terminals in position, the fuse protector base further comprises a plurality of base contacts, and each of the incoming and outgoing line terminals is connected with one base contact corresponding thereto in position, the terminals are insulated one from another, and groups of the incoming line terminal on the one side and the corresponding outgoing line terminal on the opposite side are aligned vertically, and the base contacts corresponding to their respective groups are aligned vertically;

the fuse carrier comprises at least three groups of cavities in which the fuse elements can be placed, the groups of the cavities are aligned vertically and correspond to the fuse protector base contacts in position, and when the fuse carrier is pulled out of the fuse protector base, at least six breaking points are formed at the same time; and the fuse carrier comprises at least three fuse elements, and the fuse elements are provided in the cavities of the fuse carrier, and after the fuse carrier is inserted in the fuse protector base, end surfaces of the fuse elements are electrically connected with the base contacts; and wherein the side surfaces of the fuse protector base are formed in a stepped shape, and each side surface of the fuse protector base comprises a number of stepped portions, the number of which corresponds to that of the fuse elements, and the incoming line terminals and the outgoing line terminals are disposed within the respective stepped portions.

10. The fuse protector according to claim 9, wherein the at least three fuse elements are chosen from a group consisting of pure fuse, a combination of the fuse and a current carrying component, or a combination of the fuse and a current carrying fuse component.

11. The fuse protector according to claim 10, wherein the fuse is formed as in a shape of cylinder, wherein two ends of the fuse are formed as electric conductors, a middle portion of the fuse is formed as an insulator, and a fusible core capable of carrying current and providing over current fusing protection is provided inside the fuse; and the current carrying component is formed as in a shape of cylinder, wherein two ends of the current carrying component are formed as electric conductors, a middle portion of the current carrying component is formed as an insulator, and a conductor capable of carrying current yet without fusing function is provided inside the current carrying component.

12. The fuse protector according to claim 9, wherein each of the base contacts of the fuse protector comprises an elastic member and a contact body made of metal materials.

13. The fuse protector according to claim 9, wherein the fuse carrier is provided with a handle on one end.

14. The fuse protector according to claim 9, wherein the fuse carrier is provided with at least one device for indicating fusing in the fuse protector.

* * * * *